United States Patent [19]

Bastenhof

[11] 3,963,384

[45] June 15, 1976

[54] EROSION-PREVENTING DEVICE FOR A LIFT-AND-FORCE PUMP

[75] Inventor: Dirk Bastenhof, Eaubonne, France

[73] Assignee: Societe d'Etudes de Machines Thermiques, Saint Denis, France

[22] Filed: June 27, 1975

[21] Appl. No.: 590,851

[30] Foreign Application Priority Data

July 16, 1974 France ..... 74.24747

[52] U.S. Cl. ..... 417/499; 123/139 AA

[51] Int. Cl.[2] ..... F04B 7/04

[58] Field of Search ..... 417/494, 499; 123/139 AA, 139 R

[56] References Cited

UNITED STATES PATENTS

| | | | |
|---|---|---|---|
| 2,382,000 | 8/1945 | Bremser | 417/494 |
| 2,414,261 | 1/1947 | Kalitinsky | 417/494 |
| 2,565,681 | 8/1951 | Fleck et al. | 417/494 |
| 3,438,327 | 4/1969 | Thompson | 417/494 |

FOREIGN PATENTS OR APPLICATIONS

| | | | |
|---|---|---|---|
| 686,851 | 1/1940 | Germany | 417/494 |

*Primary Examiner*—C. J. Husar

*Attorney, Agent, or Firm*—Jay L. Chaskin

[57] ABSTRACT

An erosion-preventing device in a jerk-pump of the kind comprising a cylindrical plunger reciprocating longitudinally within a bore formed in a barrel mounted in the pump housing and including a common feed and by-pass duct opening into said bore, said erosion preventing device being constituted by a wall portion, inserted longitudinally into said common duct and consisting of a partition having the shape of a flat plate or strip and inserted into said common duct.

11 Claims, 6 Drawing Figures

EROSION-PREVENTING DEVICE FOR A LIFT-AND-FORCE PUMP

The present invention relates essentially to an improvement in lift-and-force pumps of the kind comprising a common feed or suction and return or back flow duct. More particularly the invention is directed to an erosion-preventing device inserted in said duct and preventing the very violent by-pass flow occurring within said duct at the end of each delivery or discharge cycle from causing an erosion of the walls of said duct and of the pump piston or plunger itself.

It is known that a large number of pumps and in particular the fuel injection pumps for Diesel engines are single-cylinder jerk-pumps of the constant-stroke variable by-pass type including a piston or plunger reciprocating longitudinally or axially with a stroke of constant length within the bore of a barrel provided in the pump casing or housing. The plunger is moving past an inlet port terminating the fluid feed duct opening into said bore and uncovers said port at the bottom of the downward suction stroke while allowing an amount of fluid to be drawn into the barrel and covering or closing said port on the upward delivery stroke of the plunger.

It is also known that for the purpose of varying the quantity of fluid discharged at every cycle the plunger is formed on its outside surface with a recess or groove comprising a helical edge on that plunger portion which is moving past the spill and inlet port of the fuel supply duct. That recess or groove opens at the upper part or top end of the plunger so as to provide a by-pass communication at a given time in each cycle between said top portion and the feed or supply duct. As the delivery pressure is much higher than the feed pressure the fluid flows back to the feed duct as soon as the by-pass communication is established, i.e. once a point of the helical edge is moving in front of and/uncovering the spill and inlet port of the feed duct; the discharge is then stopped nearly instantaneously which implies that a well-defined amount of fluid which is independent of the actual or true plunger stroke is delivered by the pump at each cycle. Said delivered amount of fluid discharged by the pump may of course be varied by turning the plunger about its longitudinal axis so as to change the time of uncovering the by-pass port by the plunger helical edge thereby varying the duration of the effective plunger stroke in order to delay or advance the time at which the helical edge moves past the spill and inlet port of the supply duct; thus is provided a variation in the useful delivery stroke of the plunger and accordingly a variation in the quantity of fluid discharged at each cycle. For this purpose the lower portion of the plunger may comprise a slidable keying arrangement enabling to control or adjust and to keep the angular position of the plunger in a determined position with respect to the inlet port. The angular position may also be varied in follow-up or phase-locked relationship in particular when the pump is used for injecting fuel into the cylinder of a Diesel engine in which case the rate or speed of plunger reciprocation within the barrel also depends upon and is keyed to the rotational speed of the engine.

A problem is however encountered when the pressure at the discharge time which is defined by the nature of the circuit into which the pump is delivering fluid (opposing force of the injection valve, air pressure within the combustion chamber, etc . . . ), which is of such a magnitude that the by-pass or back flow occurs with a great violence giving rise to vortices inside of the supply duct in that portion of the latter which is near the inner spill and inlet port. Such vortices are likely to cause a cavitation or spalling or scaling phenomenon at the end of the duct and in the adjacent areas of the inner wall of the barrel bore as well as on the surface of the plunger proper. More specifically as the helical edge of the plunger becomes located adjacent to or in front of the bottom edge of the inlet and spill port of the feed duct the direction of the by-pass jet inside of the duct is oblique and directed upwards thereby implying that the area of lower pressure where vortices will occur is located substantially at the top portion of the inner end of the feed duct.

It has been attempted to solve the problem which has been just mentioned by dividing the supply duct in the longitudinal direction so as to define a feed passageway and a by-pass or relief passageway at the time of said by-pass flow so as to prevent the formation of areas of lower pressure and accordingly of vortices. In particular a device which has been tested comprises a cylindrical wall coaxial with said common duct and defining a (central) by-pass or relief passageway and an annular supply passageway (peripherally surrounding said central passageway); said common duct opening into the bore of the barrel through a port of smaller diameter than its own so as to provide an annular shoulder at the inner end of said common duct substantially in front of said supply passageway and protecting the latter against any risk of being hit by the by-pass flow. A communication is of course provided between the end of the cylindrical wall and the annular shoulder to allow the passage of fluid at the time of said by-pass flow. This device is however very quickly damaged in view of the small thickness of the shoulder which is undergoing a very strong erosion and deformation under the action of the successive violent jets of the by-pass flow.

The object of the present invention is therefore more particularly to provide a new type of anti-erosion device adapted to be inserted into the common duct and the shape and arrangement of which remove the necessity of providing the annular shoulder.

According to the lines set forth hereinabove the invention is therefore directed to a pump providing an adjustable flow rate, of the kind comprising a cylindrical piston or plunger reciprocating longitudinally inside of the bore of a barrel and including a common duct for the feed and by-pass flow opening into said bore, a recess or groove with a substantially helical edge defining the useful discharge stroke of the pump plunger being provided on the outside surface of said plunger, said pump being moreover provided with an anti-erosion device consisting of a wall portion inserted longitudinally into said duct and defining a return or back flow or by-pass flow passageway for the fluid and a supply or feed flow passageway, characterized in that said wall portion consists of a partition having the shape of a flat plate or strip inserted into said common duct.

It has moreover been found that in some cases the mounting with a tight-fit of the insert member or end-piece comprising said wall portion inserted into the feed duct has induced bursts and damages in the pump barrel near the inner inlet and spill port of the feed duct. To avoid such an additional inconvenience another advantageous feature of the invention is the fact that in some forms of embodiment thereof the tight-fit and the centering of the insert or end-piece carrying said wall portion against the inner surface of the duct take place only in the radially outermost regions of the latter in relation to said barrel or even inside thereof owing for instance to an extension of said insert rigidly secured to an outer structure which is stationary with respect to the barrel and located adjacent thereto.

The invention will be better understood and further objects, characterizing features, details and advantages thereof will appear more clearly as the following explanatory description proceeds with reference to the accompanying diagrammatic drawings given by way of non-limitative examples only illustrating several presently preferred specific forms of embodiment thereof and wherein.

Figure 7:
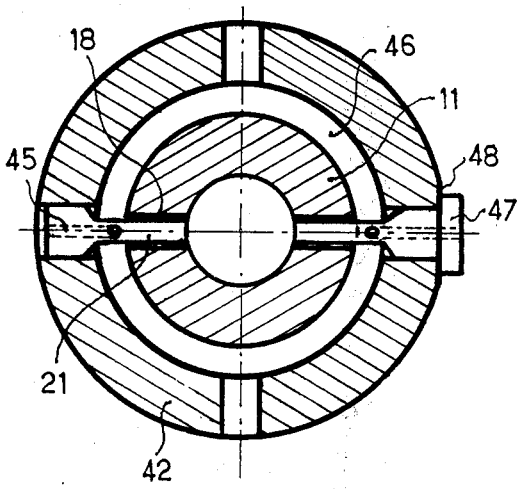
Figure 6:
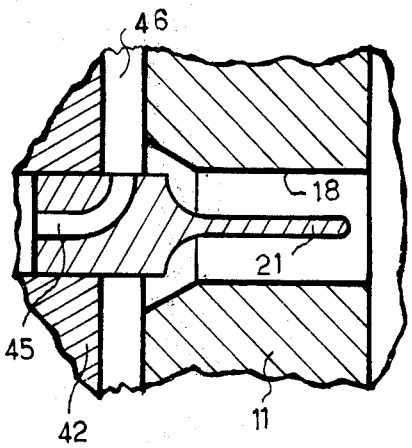

FIG. 6 shows an alternative embodiment of said advantageous feature as applied to another form of embodiment of the insert according to the invention; and FIG. 7 is a top view of a pump barrel surrounded by a stationary supporting means or casing holding the insert according to the form of embodiment shown in FIG. 6 and to a modification of the latter shown in diametrally opposite position in the same figure.

Figure 1:
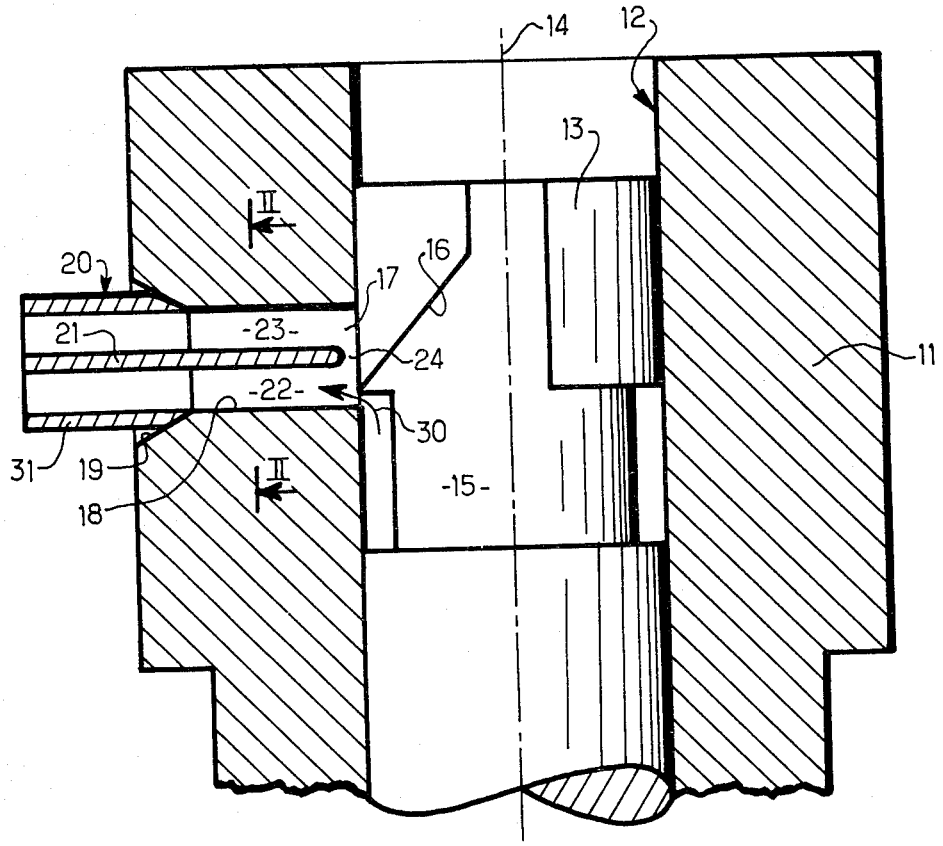
FIG. 1 is a partial sectional view of the pump barrel the common feed and by-pass duct of which is provided with an anti-erosion device according to the invention shown in such a position that the side edge of the plate portion of said device appears to be located substantially in the longitudinal centre-plane of said duct.
Figure 2:
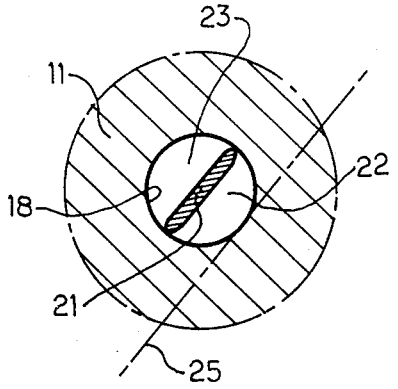
FIG. 2 is a view in section taken upon the line II—II in FIG. 1 where the anti-erosion device is seen in its true position with respect to the helical edge of the pump plunger the projection of which is shown by a straight chain-dotted line.

With reference to FIGS. 1 and 2 there has been shown a section of a jerk-pump comprising a barrel 11 formed with a central bore 12 inside of which the piston or plunger 13 may reciprocate. The slidable keying connection allowing the revolving of the plunger about its longitudinal centre-line axis 14 and retaining same in a given angular position is not shown. The plunger 13 is formed at its upper portion with a side recess or groove 15 one edge 16 of which is of helical shape. This edge is located in that active portion of the plunger 13 which normally is substantially in front of or facing towards the inner inlet and spill port 17 of the common supply and by-pass duct or passageway 18 of the pump. This duct or passageway 18 comprises a tapering or flared portion 19 enabling the insertion and proper positioning of an insert or end-piece 20 forming the essential part of the erosion-preventing or anti-cavitation device according to the present invention. The insert 20 consists essentially of a tubular member 31 from which is projecting in extension thereof a partition wall 21 in the shape of a flat plate or strip dividing the duct 18 in the longitudinal direction and thereby defining a return or by-pass flow passageway 22 for the back flow of the fluid and a supply or feed passageway 23. The partition wall 21 is recessed from the spill and inlet port 17 of the common duct 18 so as to define a passageway 24 the function of which will be described hereinafter. The optimum width of this recessed passageway 24 is lying for the type of pump described between 0.2 and 2 mm. FIG. 2 shows the actual or true transverse positioning of the partition 21 with respect to the helical edge the orthogonal projection of which on a plane extending in parallel relation to a cross-section of the duct 18 is denoted by a chain-dotted straight line 25.

Figure 3:
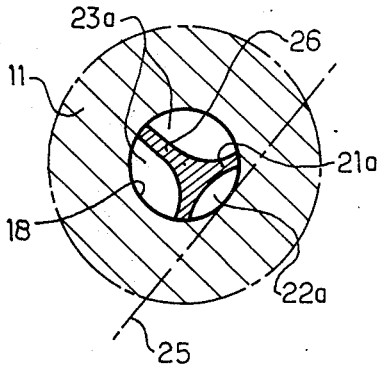
FIG. 3 is an alternative embodiment of the device shown in FIG. 2.

FIG. 3 shows a modification of the anti-cavitation device which exhibits improved characteristics of resistance to wear with respect to the form of embodiment shown in FIG. 2. It is seen that the partition 21*a* is slightly concave with respect to the by-pass passageway 20*a* and that it is provided in extension thereof on its convex face with a reinforcing rib or flange 26 extending longitudinally through the feed passageway 23*a* and bearing against the inner surface of the duct 18. As clearly shown in the drawings the anti-cavitation devices illustrated and more particularly that of FIG. 3 offers the advantage of keeping themselves positioned within the duct 18 through simple insertion. They are moreover quite interchangeable.

The function of the insert 20 forming the anti-cavitation device during the operation of the pump will now be described.

The plunger 13 is given a reciprocating motion inside of the bore 12 and according to a usual feature of this type of jerk-pump the plunger stroke is constant. The volume of fluid discharged at each cycle is adjustable and depends upon the relative angular position of the plunger 13 with respect to the spill and inlet port 17. As a matter of fact at each upward stroke of the plunger there may be defined an "effective or useful delivery stroke" which corresponds to the time during which the inlet and spill port 17 is fully closed by the side surface of the plunger 13. That time (and accordingly that useful or effective stroke) is variable since it depends upon the time at which the helical edge 16 will move past the lower part or bottom edge of the inlet and spill port 17. It should be noted that as previously stated the plunger 13 is shown in the relative angular position corresponding to the effective or useful stroke of maximum delivery just at the time of initiation of the by-pass phenomenon according to which the excess of fluid which has been drawn in is by-passed towards the duct 18 through the recess or groove 15. As a matter of fact the discharge pressure is substantially higher than the feed pressure under which the fluid is supplied to the inlet and spill port 17. Accordingly as soon as the communication is restored between the working chamber wherefrom the fluid is being discharged by the rise of the plunger 13 and the duct 18 (owing to the recess or groove 15) the remaining fluid fraction, i.e. that fluid portion which has not been expelled out of the pump is flowing back towards the duct 18. The pressure differential is however of such a magnitude that the velocity of the fluid jet which follows substantially the path of travel shown by the arrow 30 has a tendency (in the absence of the anti-cavitation device) to create a zone of vortices in the upper portion of the duct 18. In the form of embodiment shown in FIG. 1 these vortices are then tending to build up in the by-pass passageway 22 below the wall portion 21 but they are removed or reduced by a supply of fluid from the passageway 23 flowing through the passageway 24. Thus the swirl or vortex phenomena which are of short duration but violent and which were likely to occur at the end of each effective or useful delivery stroke and induce an erosion or cavitation in the terminal portion of the wall 21 are removed or at least reduced to a significant extent by the supply of fluid from the passageway 23.

Figure 4:
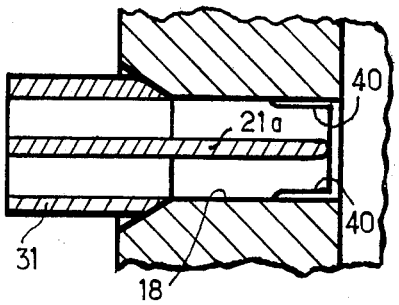
FIG. 4 shows a detail of the pump barrel illustrated in FIG. 1 fitted with the alternative embodiment of the insert wall portion according to FIG. 3 which itself exhibits said advantageous feature according to which any risk of bursting of the barrel wall in proximity to the inner inlet and spill port of the duct is removed.

The form of embodiment shown in FIG. 4 is very similar to the foregoing but the insert is terminating in a slightly recessed portion 40 provided on the terminal part of the fins or flanges. The tight-fit of the insert is however achieved as previously within the feed and by-pass duct 18 except for the area next to its inner inlet and spill port.

Figure 5:
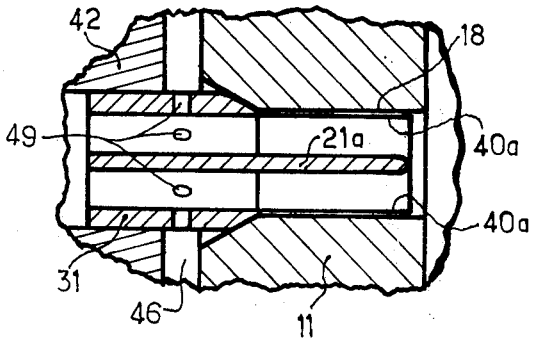
FIG. 5 shows another modification of said advantageous feature applied to the same form of embodiment of said insert or end-piece.

On the other hand the forms of embodiment according to FIGS. 5 to 7 enable to secure the device within an outer part or casing surrounding the barrel 11 while leaving a clearance between said device and the wall portion of the feed and by-pass duct. Thus an outer stationary part or casing 42 has the shape of a ring completely surrounding the barrel 11 and the fluid is completely filling the annular space 46. In FIG. 5 the recessed section 40*a* extends over the whole lengths of the fins or flanges and the fluid may flow into the space 46 owing to the provision of several thoroughfare holes 49. FIGS. 6 and 7 show another alternative embodiment making use of an insert derived from that shown in FIG. 2. The fluid will flow into the curved duct 45 to fill the space 46. The insert strip 21 is of course not in tightly clamped engagement with the inner wall of the duct 18 since the tight-fit and the centering of the insert are achieved at the stationary outer part or casing 42 in a manner similar to that shown in FIG. 5. The tight-fit and centering may also be improved owing to the provision of an outer shoulder, head or collar 47 of the insert co-operating with a flat portion 48 formed in the part or casing 42.

It should be understood that the invention is not at all limited to the forms of embodiment which have been described hereinabove and it comprises all the technical equivalents of the means described if same are used within the scope of the appended claims.

What is claimed is:

1. A jerk-pump with an adjustable discharge flow rate, of the kind comprising a cylindrical plunger reciprocating longitudinally within a bore formed in a barrel mounted in the pump housing and including a common feed and by-pass duct opening into said bore, a groove-like recess having a substantially helical edge defining the effective delivery stroke of said plunger being formed in the external surface of said plunger, said pump being provided with an erosion-preventing device consisting of a wall portion inserted longitudinally into said common duct and defining a fluid return or by-pass passageway and a supply or feed passageway, wherein the improvement consists in that said wall portion consists of a partition having the shape of a flat plate or strip and inserted into said common duct.

2. A pump according to claim 1, wherein a passageway is provided between said supply passageway and said by-pass passageway inside of said common duct near an inlet an spill port of said common duct opening into said bore.

3. A pump according to claim 2, characterized in that at least one portion of the terminal inner end edge or face of said partition is recessed from said inlet and spill port of said common duct opening into said bore.

4. A pump according to claim 1, wherein said insert is removable and interchangeable.

5. A pump according to claim 1, wherein said inner terminal end edge or face of said partition extends in substantially parallel relation to the orthogonal projection of said helical edge onto a plane extending in parallel relation to a cross-section of said common duct.

6. A pump according to claim 1, wherein said partition is curved transversely.

7. A pump according to claim 1, wherein said partition comprises at least one reinforcing rib or flange extending longitudinally inside of said supply passageway over at least one portion of the length of said passageway.

8. A pump according to claim 3, wherein the recessed portion of said inner terminal end edge or face of said partition is set back from said inlet and spill port of said common duct by a distance lying between 0.2 and 2 mm.

9. A pump according to claim 1, wherein said partition is integral with an insert or end-piece inserted in said common duct and said insert is shaped so as to prevent any generation of stresses likely to result from its insertion into said common duct into that portion thereof which is next to its inner inlet and spill port.

10. A pump according to claim 9, wherein said partition is substantially narrower or is peripherally set back or recessed in at least its portion next to said inlet and spill port.

11. A pump according to claim 10, wherein the tight-fit and centering of said insert are achieved at least partially on a stationary outer member or casing surrounding said barrel in spaced relationship.

* * * * *